US011195646B2

(12) United States Patent
Kojima et al.

(10) Patent No.: US 11,195,646 B2
(45) Date of Patent: Dec. 7, 2021

(54) SOFT MAGNETIC ALLOY POWDER AND DUST CORE USING SAME

(71) Applicant: Panasonic Intellectual Property Management Co., Ltd., Osaka (JP)

(72) Inventors: Toshiyuki Kojima, Kyoto (JP); Masato Maede, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 236 days.

(21) Appl. No.: 16/016,621

(22) Filed: Jun. 24, 2018

(65) Prior Publication Data

US 2019/0013123 A1 Jan. 10, 2019

(30) Foreign Application Priority Data

Jul. 5, 2017 (JP) ..... JP2017-132079

(51) Int. Cl.

| | |
|---|---|
| ***H01F 1/147*** | (2006.01) |
| ***B22F 9/04*** | (2006.01) |
| ***B22F 1/00*** | (2006.01) |
| ***C22C 33/02*** | (2006.01) |
| ***H01F 1/153*** | (2006.01) |
| ***H01F 3/08*** | (2006.01) |

(52) U.S. Cl.

CPC ..... *H01F 1/147* (2013.01); *B22F 1/0085* (2013.01); *B22F 9/04* (2013.01); *C22C 33/0207* (2013.01); *H01F 1/15333* (2013.01); *H01F 3/08* (2013.01); *B22F 2009/047* (2013.01); *B22F 2301/35* (2013.01); *B22F 2998/10* (2013.01); *B22F 2999/00* (2013.01); *H01F 1/15308* (2013.01)

(58) Field of Classification Search

None

See application file for complete search history.

(56) References Cited

U.S. PATENT DOCUMENTS

2016/0155566 A1* 6/2016 Yoon ..... B22F 9/04 336/233

2018/0169759 A1 6/2018 Nakamura et al.

FOREIGN PATENT DOCUMENTS

| | | | | |
|---|---|---|---|---|
| CN | 105378866 A | | 3/2016 | |
| JP | 2001068324 A | * | 3/2001 | ..... H01F 41/0246 |
| JP | 5537534 B | | 7/2014 | |

(Continued)

OTHER PUBLICATIONS

Zhang (Materials Transactions, 2011, vol. 52, No. 12, p. 2254-2257). (Year: 2011).*

(Continued)

*Primary Examiner* — Xiaowei Su

(74) *Attorney, Agent, or Firm* — McDermott Will and Emery LLP

(57) ABSTRACT

Provided herein is a soft magnetic alloy powder that can exhibit a high saturation flux density and desirable soft magnetic characteristics. A dust core using the soft magnetic alloy powder is also provided. The soft magnetic alloy powder is an Fe-based nanocrystalline soft magnetic alloy powder of a crystallized Fe-based amorphous soft magnetic alloy powder, and has a DSC curve with a first peak that is 15% or less of a first peak of the Fe-based amorphous soft magnetic alloy in terms of a maximum value.

9 Claims, 2 Drawing Sheets

(56) References Cited

FOREIGN PATENT DOCUMENTS

JP 2017-034091 A 2/2017

OTHER PUBLICATIONS

Zhang2 (Trans Tech, 2012, vol. 508, p. 133-140). (Year: 2012).*
English Translation of Chinese Search Report dated Nov. 30, 2020 for the related Chinese Patent Application No. 201810686928.8.
English Translation of Chinese Search Report dated Jun. 15, 2021 for the related Chinese Patent Application No. 201810686928.8.

* cited by examiner

RELATED ART

SOFT MAGNETIC ALLOY POWDER AND DUST CORE USING SAME

TECHNICAL FIELD

The technical field relates to a soft magnetic alloy powder, and a dust core using same. Specifically, the present disclosure relates to an Fe-based nanocrystalline soft magnetic alloy powder used for inductor applications such as in choke coils, reactors, and transformers, and a method for producing such a soft magnetic alloy powder, and to a dust core using the Fe-based nanocrystalline soft magnetic alloy powder.

BACKGROUND

The last years have seen rapid advances in the development of electrically powered automobiles, including hybrid electric vehicles (HEVs), plug-in hybrid electric vehicles (PHEVs), and electric vehicles (EVs). For improved fuel economy, there is a demand for making smaller and lighter systems for these vehicles. The growing market for electrically powered automobiles has also created a demand for making various electronic components smaller and lighter, and there is an increasing demand for higher performance in soft magnetic alloy powders used for choke coils, reactors, and transformers, and in dust cores using soft magnetic alloy powders.

For miniaturization and lightness, the materials used for soft magnetic alloy powders and dust cores using same require a high saturation flux density and a small core loss. Soft magnetic alloy powders, and dust cores using soft magnetic alloy powders also require desirable DC bias characteristics.

An Fe-based nanocrystalline soft magnetic alloy is a type of soft magnetic alloy powder with a micro αFe crystalline phase precipitated in an amorphous phase, and has excellent properties satisfying both high saturation flux density and small core loss.

For example, Japanese Patent Number 5537534 describes an Fe-based nanocrystalline soft magnetic alloy powder, and a method for producing same. A dust core using the Fe-based nanocrystalline soft magnetic alloy powder, and a method for producing the dust core are also described.

SUMMARY

FIG. 2 shows a DSC (differential scanning calorimetry) curve 110 of a traditional Fe-based amorphous soft magnetic alloy ribbon. Here, DSC is based on the direct measurement of a ribbon produced by quenching, without pulverization.

The DSC curve 110 occurs after continuously heating the ribbon at a predetermined rate of temperature increase, and has two or more exothermic peaks, including a first peak 111 and a second peak 115. The first peak 111 is an exothermic peak on the low-temperature side, whereas the second peak 115 is an exothermic peak occurring on the high-temperature side of the first peak 111.

The first peak 111 occurs upon precipitation of an αFe crystalline phase, a nanocrystal that improves magnetic characteristics. The first peak 111 represents an exothermal reaction that takes place when the Fe-based amorphous soft magnetic alloy ribbon first crystallizes (first crystallization). The precipitate produced by the first crystallization is mainly the αFe crystalline phase, a nanocrystal that improves magnetic characteristics, and it is desirable to increase the content of this phase.

The second peak 115 represents an exothermal reaction that takes place when the alloy ribbon undergoes another crystallization (second crystallization). The second peak 115 occurs upon precipitation of an alloy that impairs magnetic characteristics. The precipitate produced by the second crystallization is mainly an alloy that deteriorates magnetic characteristics, and the alloy enlarges nanocrystals.

The intersection between a first rise tangent line 132 and a base line 124 defines a first crystallization start temperature T11. Here, the first rise tangent line 132 is the tangent line that passes through the point where the positive slope is the largest in a first rise portion 112 connecting the base line 124 of the DSC curve 110 to the first peak 111.

Likewise, the intersection between a second rise tangent line 142 and a base line 125 defines a second crystallization start temperature T21. Here, the second rise tangent line 142 is the tangent line that passes through the point where the positive slope is the largest in a second rise portion 116 connecting the base line 125 to the second peak 115.

Ideally, the first peak 111 should be completely absent in an Fe-based nanocrystalline soft magnetic alloy powder. This is because the absence of the first peak 111 means that nanocrystallization, which improves magnetic characteristics, has fully taken place. However, the first peak 111 does not completely disappear in an Fe-based nanocrystalline soft magnetic alloy powder formed by nanocrystallization of an amorphous soft magnetic alloy powder. This means that nanocrystallization is insufficient.

The DSC curve should ideally have a larger second peak 115. This is because a larger second peak means that the precipitation of an alloy that impairs magnetic characteristics has not taken place. However, a very small second peak 115 is present in an Fe-based nanocrystalline soft magnetic alloy powder. This indicates that an alloy that impairs magnetic characteristics has precipitated in a large amount.

In either case, the Fe-based nanocrystalline soft magnetic alloy powder exhibits large magnetic anisotropy, and a large loss occurs in the Fe-based nanocrystalline soft magnetic alloy powder.

There is indeed a need to eliminate the first peak 111 while maximizing the second peak 115 at the same time. However, it has been difficult to achieve this, and to produce a nanocrystalline soft magnetic alloy powder having desirable magnetic characteristics.

The present disclosure is intended to provide a solution to the foregoing problem of the related art, and it is an object of the present disclosure to provide an Fe-based nanocrystalline soft magnetic alloy powder that exhibits high saturation flux density and desirable soft magnetic characteristics, and a dust core using such an Fe-based nanocrystalline soft magnetic alloy powder.

According to an aspect of the disclosure, there is provided an Fe-based nanocrystalline soft magnetic alloy powder of a crystallized Fe-based amorphous soft magnetic alloy powder, the Fe-based nanocrystalline soft magnetic alloy powder having a DSC curve with a first peak that is 15% or less of a first peak of the Fe-based amorphous soft magnetic alloy in terms of a maximum value, the DSC curve of the Fe-based nanocrystalline soft magnetic alloy powder having a second peak occurring on a higher temperature side of the first peak of the Fe-based nanocrystalline soft magnetic alloy powder and having a maximum value that is 50% or more and 100% or less of a maximum value of a second peak of the Fe-based amorphous soft magnetic alloy occurring on a higher temperature side of the first peak of the Fe-based amorphous soft magnetic alloy.

According to another aspect of the disclosure, there is provided a method for producing an Fe-based nanocrystalline soft magnetic alloy powder, the method including:

pulverizing an Fe-based amorphous soft magnetic alloy composition into a powder; and subjecting the powder to a heat treatment to precipitate an αFe crystalline phase and produce an Fe-based nanocrystalline soft magnetic alloy powder so that a DSC curve of the Fe-based nanocrystalline soft magnetic alloy powder has a first peak that is 15% or less of a first peak of the Fe-based amorphous soft magnetic alloy ribbon in terms of a maximum value, and that the DSC curve of the Fe-based nanocrystalline soft magnetic alloy powder has a second peak having a maximum value that is 50% or more and 100% or less of a maximum value of a second peak of the Fe-based amorphous soft magnetic alloy ribbon.

The means disclosed in the embodiment can provide an Fe-based nanocrystalline soft magnetic alloy powder capable of reducing the loss associated with a soft magnetic alloy powder, and exhibiting high saturation flux density and desirable soft magnetic characteristics, and a dust core using such an Fe-based nanocrystalline soft magnetic alloy powder.

DESCRIPTION OF EMBODIMENTS

Embodiments are described below with reference to the accompanying drawings.

Embodiments

An alloy powder of an embodiment is an Fe-based nanocrystalline soft magnetic alloy powder containing an αFe crystalline phase that has precipitated in an amorphous phase upon heating a pulverized Fe-based amorphous soft magnetic alloy ribbon.

The Fe-based amorphous soft magnetic alloy ribbon is pulverized to produce an alloy powder. In the embodiment, the material of the alloy powder is an Fe-based nanocrystalline soft magnetic alloy powder. The Fe-based nanocrystalline soft magnetic alloy powder can exhibit high saturation flux density, and excellent magnetic characteristics with a small loss. The method of production will be described later.

The Fe-based alloy powder may be an Fe—Si—B alloy. Other examples include an Fe—Si—B-based alloy, an Fe—Cr—P-based alloy, an Fe—Zr—B-based alloy, and a Sendust-based alloy, which are alloys produced by adding additional elements such as Nb, Cu, P, and C to the Fe—Si—B alloy.

DSC

Figure 1:
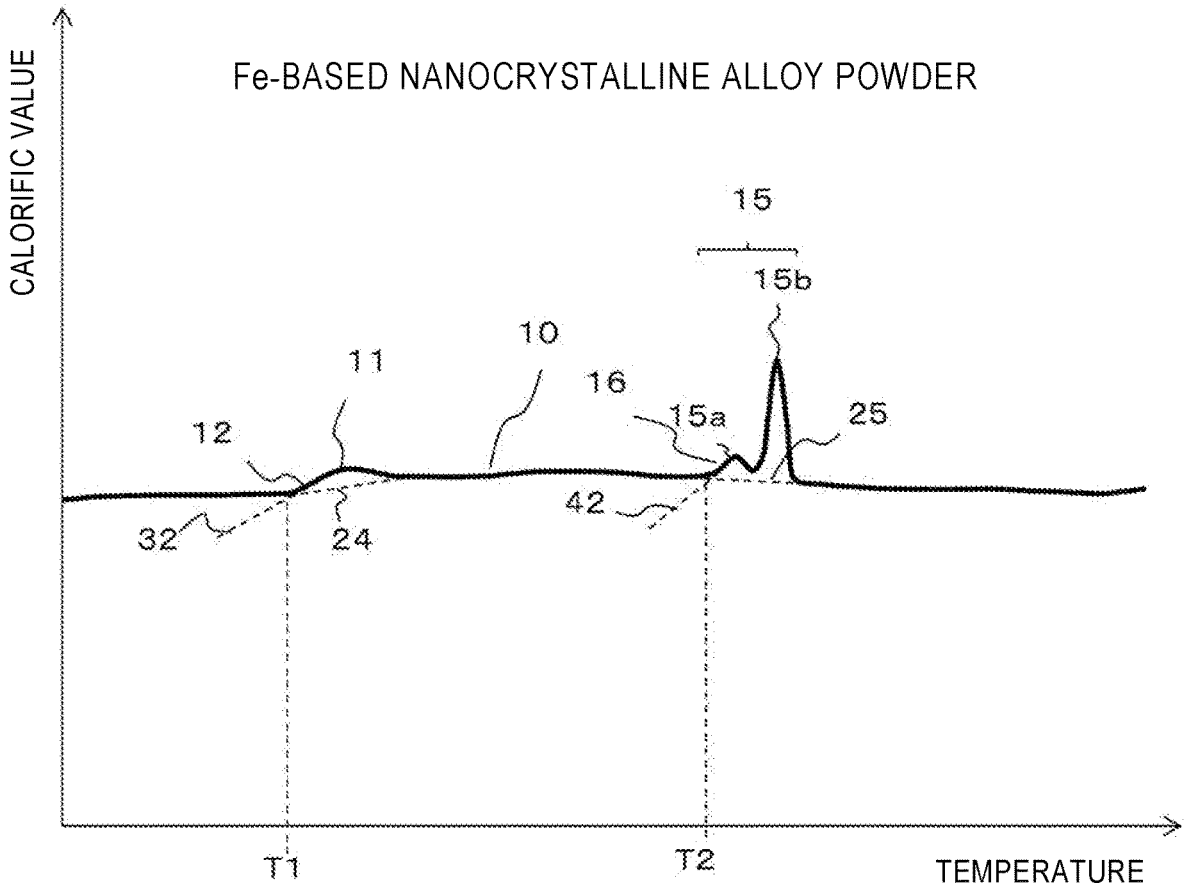
FIG. 1 is a diagram showing a DSC curve of an Fe-based nanocrystalline soft magnetic alloy powder of an embodiment.

FIG. 1 is a diagram showing a DSC (differential scanning calorimetry) curve of the Fe-based nanocrystalline soft magnetic alloy powder of the embodiment. The Fe-based nanocrystalline soft magnetic alloy used has the same composition as the traditional Fe-based amorphous soft magnetic alloy ribbon shown in FIG. 2. The difference is the ways the Fe-based nanocrystalline soft magnetic alloy was pulverized and heat treated.

FIG. 1 shows a DSC curve of the Fe-based nanocrystalline soft magnetic alloy powder of the present embodiment.

As shown in FIG. 1, the Fe-based nanocrystalline soft magnetic alloy powder produces a DSC curve 10 with a first peak 11 and a second peak 15 when continuously heated at a predetermined rate of temperature increase.

Figure 2:
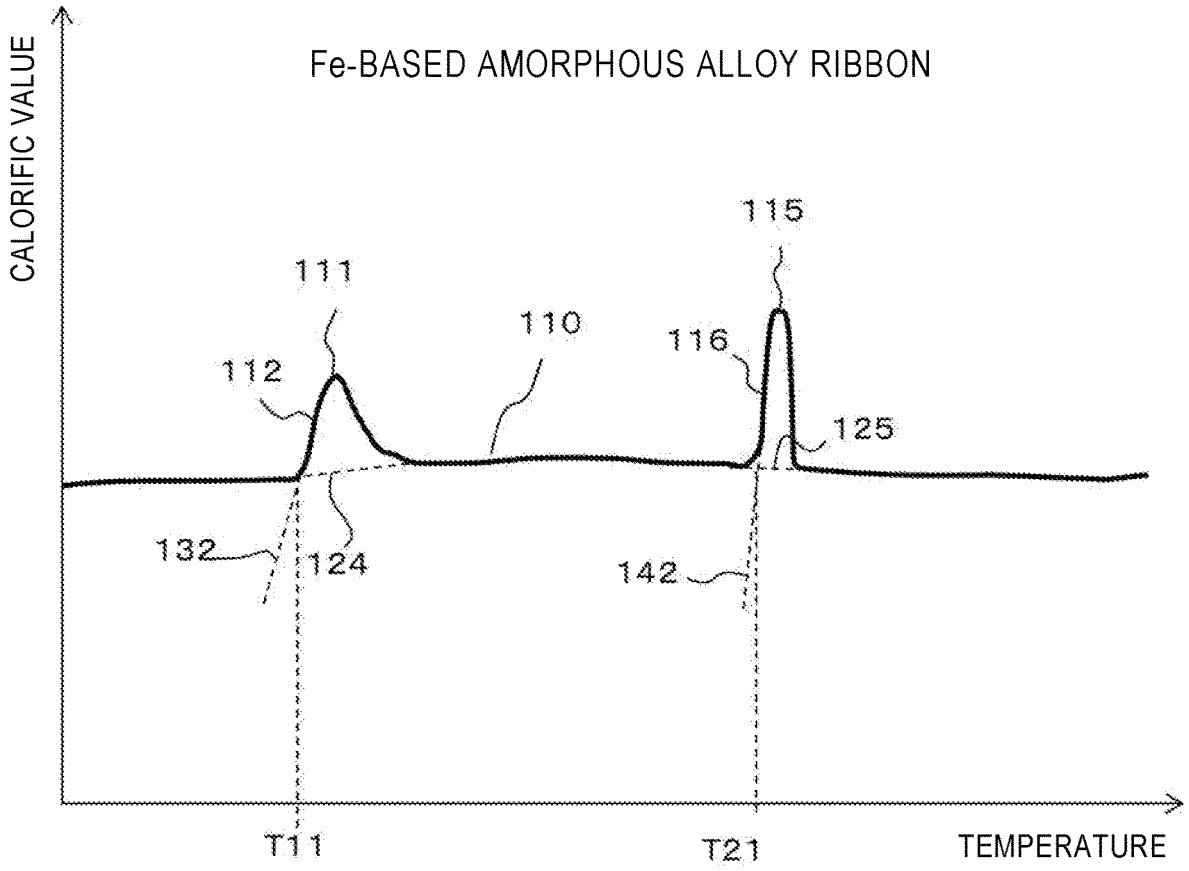
FIG. 2 is a diagram showing a DSC curve of an Fe-based amorphous soft magnetic alloy ribbon of related art.

The first peak 11 of the Fe-based nanocrystalline soft magnetic alloy powder occurs in substantially the same temperature region as the first peak 111 of the traditional Fe-based amorphous soft magnetic alloy ribbon (FIG. 2). The second peak 15 also occurs in substantially the same temperature region as the second peak 115 of the related art.

This is because the Fe-based nanocrystalline soft magnetic alloy powder of the embodiment has the same composition as the traditional Fe-based amorphous soft magnetic alloy ribbon. The second peak 15 of the embodiment has two peaks: a low-temperature-side second peak 15*a*, and a high-temperature-side second peak 15*b*.

The intersection between a first rise tangent line 32 and a base line 24 defines a first crystallization start temperature T1. Here, the first rise tangent line 32 is the tangent line that passes through the point where the positive slope is the largest in a first rise portion 12 connecting the base line 24 of the DSC curve 10 to the first peak 11.

Likewise, the intersection between a second rise tangent line 42 and a base line 25 defines a second crystallization start temperature T2. Here, the second rise tangent line 42 is the tangent line that passes through the point where the positive slope is the largest in a second rise portion 16 connecting the base line 25 to the low-temperature-side second peak 15*a*.

The first peak 11 represents an exothermal reaction that takes place when the Fe-based nanocrystalline soft magnetic alloy powder first crystallizes (first crystallization). The second peak 15 represents an exothermal reaction that takes place when the alloy powder undergoes another crystallization (second crystallization).

The precipitate produced by the first crystallization is mainly an αFe crystalline phase, a nanocrystal that improves magnetic characteristics.

The precipitate produced by the second crystallization is mainly an alloy that deteriorates magnetic characteristics.

In the Fe-based nanocrystalline soft magnetic alloy powder of the embodiment, the Fe-based nanocrystalline soft magnetic alloy powder exhibits excellent magnetic characteristics by promoting first crystallization, and not promoting second crystallization.

That is, it is important that the first peak 11 in the DSC curve 10 of the Fe-based nanocrystalline soft magnetic alloy powder be as small as possible, and the second peak 15 remain as large as possible.

Specifically, in the DSC curve 10 of the Fe-based nanocrystalline soft magnetic alloy powder of the embodiment shown in FIG. 1, the first peak 11 should be smaller than in the traditional Fe-based amorphous soft magnetic alloy ribbon of FIG. 2 as much as possible, whereas the second peak 15 of the alloy powder shown in FIG. 1 should be made as large as possible. In other words, the second peak 15 should have a peak value as close as possible to the second peak 115 of the alloy ribbon shown in FIG. 2.

As shown in FIG. 1, the first peak 11 is almost absent in the Fe-based nanocrystalline soft magnetic alloy powder of the present embodiment. However, the second peak 15 is present. The second peak 15 has two peaks: a low-temperature-side second peak 15*a*, and a high-temperature-side second peak 15*b*.

First Peak 11

The first peak 11 is described first. The first peak 11 of the embodiment is smaller than the first peak 111 of the related art. The presence of a large first peak 11 means that the amorphous phase can still undergo nanocrystallization. It is accordingly desirable to make the first peak 11 as small as possible.

The maximum value of the first peak 11 is preferably 15% or less of the maximum value of the first peak 111. When the maximum value of the first peak 11 is larger than 15%, it means that the powder has not sufficiently undergone nanocrystallization, and the loss is still large. More preferably, the maximum value of the first peak 11 is 10% or less of the maximum value of the first peak 111. A maximum value of 10% or less means that nanocrystallization has proceeded further, and the loss is smaller. This is effective in high-frequency devices, which require a small loss.

Second Peak 15

The second peak 15 is described below. The second peak 15 remains large. A small second peak 15 means that an alloy that deteriorates magnetic characteristics has precipitated in a large amount. It is accordingly desirable that a large second peak 15 remain.

The maximum value of the second peak 15 is preferably 50% or more and 100% or less of the maximum value of the second peak 115. When the maximum value of the second peak 15 is smaller than 50%, it means that an alloy that deteriorates magnetic characteristics has precipitated in a large amount, and the loss is still large.

More preferably, the maximum value of the second peak 15 is preferably 60% or more and 100% or less of the maximum value of the second peak 115. A maximum value of 60% or more means that an alloy that deteriorates magnetic characteristics has precipitated in smaller amounts, and the loss is smaller. This is effective in high-frequency devices, which require a small loss.

Method of Production

In a traditional method of producing an Fe-based nanocrystalline soft magnetic alloy powder, an atomized amorphous alloy powder prepared by using an atomization method is subjected to a heat treatment to precipitate nanocrystals, and produce an atomized nanocrystal alloy powder. It is, however, difficult to maintain a second peak 15 that is 50% or more of the second peak of a ribbon of the same composition.

The atomized amorphous alloy powder is obtained by pulverizing a molten alloy with a medium such as gas and water, followed by cooling. Here, the quality of the amorphous alloy becomes more desirable as the rate of cooling increases. This is because an amorphous-state alloy can be produced when the alloy cools and solidifies faster than it crystallizes. However, in principle, the atomization method does not allow quenching.

The resulting atomized amorphous alloy powder therefore does not have a well organized amorphous state, but contains a large amount of an alloy component that impairs magnetic characteristics.

Accordingly, the atomized nanocrystal alloy powder obtained from the atomized amorphous alloy powder after a heat treatment through nanocrystallization also contains a large amount of an alloy component that impairs magnetic characteristics. This makes the second peak 15 smaller in a DSC curve of the atomized nanocrystal alloy powder.

The atomized nanocrystal alloy powder of the embodiment thus has a second peak 15 that is smaller than 50% of the second peak 115 of the Fe-based amorphous soft magnetic alloy ribbon of the related art.

On the other hand, the Fe-based amorphous soft magnetic alloy ribbon of the embodiment can be obtained by liquid quenching. Liquid quenching allows quenching of a molten alloy, and the resulting Fe-based amorphous soft magnetic alloy ribbon has a well organized amorphous state with hardly any precipitation of an alloy component that impairs magnetic characteristics. A DSC analysis thus detects a large amount of an alloy component that impairs magnetic characteristics, and a large second peak 115 is observed.

Heat Treatment

However, the Fe-based nanocrystalline soft magnetic alloy powder of the embodiment cannot be obtained simply by causing precipitation of nanocrystals through heat treatment of an alloy powder produced by pulverizing an Fe-based amorphous soft magnetic alloy ribbon prepared by quenching.

The following describes a process by which the Fe-based nanocrystalline soft magnetic alloy powder is obtained through precipitation of nanocrystals in a heat treatment of an alloy powder obtained by pulverizing an Fe-based amorphous soft magnetic alloy ribbon.

The heat-treatment temperature is described first. First, the first crystallization start temperature T1, and the second crystallization start temperature T2 are found from a DSC curve (not shown) of an alloy powder pulverized from an Fe-based amorphous soft magnetic alloy ribbon. The heat-treatment temperature is a temperature between the first crystallization start temperature T1 and the second crystallization start temperature T2, and it is important to control the powder temperature in this temperature range.

An aggregate of pulverized alloy powders from the Fe-based amorphous soft magnetic alloy ribbon has a space between powders, and the thermal conductivity is low. Accordingly, in a heat treatment using a hot-air furnace, the heat does not sufficiently transfer to all powders, and the powder temperature does not sufficiently increase during the heat treatment.

On the other hand, a hot-air furnace is not heat absorbing, and thermal runaway occurs in some of the powders as a result of self-heating due to precipitation of the αFe crystalline phase. This overly increases the powder temperature during the heat treatment.

That is, in a heat treatment using a hot-air furnace, the powder temperature becomes too low during the heat treatment, and the extent of nanocrystallization becomes insufficient, creating a large first peak 11 in a DSC curve of the Fe-based nanocrystalline soft magnetic alloy powder produced by the heat treatment. The powder temperature may instead overly increase, and create a second peak 15 that is too small.

Heating with optimum temperature control is possible for all powders of the Fe-based amorphous soft magnetic alloy ribbon when, for example, the alloy powder is heated with a hot press at 550° C. for 20 seconds.

A heat treatment using a hot press heats the pulverized alloy powder of the Fe-based amorphous soft magnetic alloy ribbon from above and below, and has high thermal conductivity. It is also possible to absorb the generated heat of powder when the powder temperature becomes higher than the hot press as a result of self-heating due to precipitation of the αFe crystalline phase.

This enables the powder temperature during the heat treatment to be controlled between the first crystallization start temperature and the second crystallization start temperature of the alloy powder pulverized from the Fe-based amorphous soft magnetic alloy ribbon.

The Fe-based nanocrystalline soft magnetic alloy powder produced by the heat treatment can thus produce a DSC curve 10 with a small first peak 11 that is 15% or less of the first peak 111, and a second peak 15 that is 50% or more and 100% or less of the second peak 115.

That is, nanocrystallization from the amorphous phase is promoted in the Fe-based nanocrystalline soft magnetic alloy powder of the embodiment, and precipitation of an alloy that deteriorates magnetic characteristics can be reduced.

Low-Temperature-Side Second Peak 15*a*, and High-Temperature-Side Second Peak 15*b*

Preferably, the second peak 15 has a structure with a low-temperature-side second peak 15*a*, and a high-temperature-side second peak 15*b*. This is because a dust core produced from an Fe-based nanocrystalline soft magnetic alloy powder having two second peaks as in the embodiment has a smaller loss than in a dust core produced from an Fe-based nanocrystalline soft magnetic alloy powder having only one second peak.

The low-temperature-side second peak 15*a* that occurs on the low-temperature side represents heat generation from the Fe-based nanocrystalline soft magnetic alloy powder of a smaller grain size, whereas the high-temperature-side second peak 15*b* that occurs on the high-temperature side represents the Fe-based nanocrystalline soft magnetic alloy powder of a larger grain size. The average grain size is 8 μm for smaller powders, and 50 μm for larger powders. Preferably, the high-temperature-side second peak 15*b* is larger than the low-temperature-side second peak 15*a*. This is because a powder of a larger grain size involves less damage due to pulverization, and causes a smaller loss, and should be contained in a larger proportion.

As discussed above, a smaller loss can be achieved with a dust core produced by densely packing powders of larger and smaller grain sizes, and that does not involve deterioration of magnetic characteristics.

Preferably, the temperature of the second peak 15 of the Fe-based nanocrystalline soft magnetic alloy powder of the embodiment occurs in a temperature range that is −60° C. to +10° C. of the temperature of the second peak 115. Here, "temperature of the second peak 15" refers to the temperature at the maximum of the second peak 15. In the Fe-based nanocrystalline soft magnetic alloy powder of the embodiment, the second peak 15 shifts to the lower temperature side as the powder is pulverized further. When the Fe-based nanocrystalline soft magnetic alloy powder is pulverized to such an extent that the second peak 15 occurs at −60° C. or less, the damage caused by pulverization increases, and the magnetic characteristics deteriorates. The Fe-based nanocrystalline soft magnetic alloy powder producing a second peak 15 on the lower temperature side is probably the result of the alloy powder storing the energy of impact due to pulverization and being more prone to reaction.

The Fe-based nanocrystalline soft magnetic alloy powder has the same composition as the raw material Fe-based amorphous soft magnetic alloy ribbon, and these share similar properties. It remains elusive as to the principle by which the second peak 15 shifts to the higher temperature side. However, the upper limit is +10° C., taking into account a possible shift of the second peak 15 due to a slight composition change that may occur as a result of pulverization.

Production of Soft Magnetic Alloy Powder of Embodiment

A method for producing a soft magnetic alloy powder of an embodiment is described below.

(1) An alloy composition (Fe—Si—B—Cu—Nb) that precipitates fine crystals of αFe crystalline phase is melted by means of, for example, high-frequency heating, and an Fe-based amorphous soft magnetic alloy ribbon is produced by liquid quenching. A single-roll or twin-roll manufacturing apparatus may be used for the liquid quenching that produces the Fe-based amorphous soft magnetic alloy ribbon.

(2) The Fe-based amorphous soft magnetic alloy ribbon is pulverized into a powder. The Fe-based amorphous soft magnetic alloy ribbon may be pulverized using a common pulverizer. For example, a ball mill, a stamping mill, a planetary mill, a cyclone mill, a jet mill, or a rotary mill may be used.

As an example, the Fe-based amorphous soft magnetic alloy ribbon may be pulverized with a rotary mill at 1,000 rpm to 3,000 rpm for 5 minutes to 30 minutes.

(3) The pulverized powder of Fe-based amorphous soft magnetic alloy ribbon is then subjected to a heat treatment to precipitate the αFe crystalline phase, and produce an Fe-based nanocrystalline soft magnetic alloy powder. A heat-treatment device, for example, such as a hot-air furnace, a hot press, a lamp, a metal sheathed heater, a ceramic heater, and a rotary kiln may be used.

Preferably, the heat treatment is performed with a hot press. The hot-press method includes pressing with a heated plate, and pressing with a heated roll. The plate pressing provides stable surface accuracy, and is advantageous in terms of a small heat-treatment variation. The roll pressing enables a continuous process, and is advantageous in terms of mass production. The roll pressing includes a method that directly feeds the alloy powder to the roll, and a method in which the alloy powder is heat treated between sheet-like objects having high thermal conductivity, for example, such as metal foils. Direct feeding of the alloy powder to the roll enables a more desirable heat treatment because it provides higher heat conduction.

Aside from hot pressing, a method that uses induction heating may be used. Particularly preferred is a method in which the alloy powder is heat treated between highly heat-conductive sheet-like objects that can be easily heated by induction heating, for example, such as metal foils. Induction heating allows rapid heating, and the heat more easily transfers to the powder. Thermal runaway due to self-heating of the alloy powder also can be reduced by the heat absorbing effect of the sheets.

The following describes the heat-treatment temperature in greater detail. The first crystallization start temperature T1, and the second crystallization start temperature T2 are found in advance from a DSC curve of an alloy powder pulverized from an Fe-based amorphous soft magnetic alloy ribbon. The heat-treatment temperature is a temperature between the first crystallization start temperature T1 and the second crystallization start temperature T2, and it is important to control the powder temperature in this temperature range.

Specifically, heating with optimum temperature control is possible when, for example, the alloy powder is heated with a hot press at 550° C. for 20 seconds.

An aggregate of pulverized alloy powders from the Fe-based amorphous soft magnetic alloy ribbon has a space between powders, and the thermal conductivity is low. Accordingly, in a heat treatment using a hot-air furnace, the heat does not sufficiently transfer to all powders, and the powder temperature does not sufficiently increase during the heat treatment. On the other hand, a hot-air furnace is not heat absorbing, and thermal runaway occurs in some of the powders as a result of self-heating due to precipitation of the αFe crystalline phase. This overly increases the powder temperature during the heat treatment. That is, in a heat treatment using a hot-air furnace, the powder temperature becomes too low during the heat treatment, and the extent of nanocrystallization becomes insufficient, creating a large first peak 11 in a DSC curve of the Fe-based nanocrystalline soft magnetic alloy powder produced by the heat treatment. The powder temperature may instead overly increase, and create a second peak 15 that is too small. This means that an alloy that impairs magnetic characteristics has precipitated in a large amount. As a result, a large loss occurs in the soft magnetic alloy powder.

On the other hand, a heat treatment using a hot press heats the pulverized alloy powder of the Fe-based amorphous soft magnetic alloy ribbon from above and below, and has high thermal conductivity. It is also possible to absorb the generated heat of powder when the powder temperature becomes higher than the hot press as a result of self-heating due to precipitation of the αFe crystalline phase. This enables the powder temperature during the heat treatment to be controlled between the first crystallization start temperature T1 and the second crystallization start temperature T2 of the alloy powder pulverized from the Fe-based amorphous soft magnetic alloy ribbon. The Fe-based nanocrystalline soft magnetic alloy powder produced by the heat treatment can thus produce a DSC curve with a small first peak 11 while retaining the second peak 15. That is, nanocrystallization from the amorphous phase is promoted in the Fe-based nanocrystalline soft magnetic alloy powder, and precipitation of an alloy that deteriorates magnetic characteristics can be reduced.

Presumably, in such a crystal state, the magnetic anisotropy of the Fe-based nanocrystalline soft magnetic alloy powder becomes smaller as it levels out, and the loss becomes smaller in the Fe-based nanocrystalline soft magnetic alloy powder. A dust core using such an Fe-based nanocrystalline soft magnetic alloy powder can have a smaller core loss accordingly.

The Fe-based nanocrystalline soft magnetic alloy powder is not limited to the composition of the embodiment, and may have any composition, as long as fine crystals of αFe crystalline phase can precipitate.

Effect of Dust Core

The dust core of the present embodiment had a loss that was at least 40% smaller than in the related art. The dust core of the present embodiment had a core loss of 1,040 $kW/m^3$, whereas a dust core of related art had a core loss of 1,745 $kW/m^3$, or higher than the measurement limit of 4,000 $kW/m^3$ as measured at a frequency of 1 MHz, and a magnetic flux density of 25 mT using a B—H analyzer.

The embodiment enables production of an Fe-based nanocrystalline soft magnetic alloy powder that can exhibit a high saturation flux density and desirable soft magnetic characteristics, and a dust core using such an Fe-based nanocrystalline soft magnetic alloy powder.

What is claimed is:

1. An Fe-based nanocrystalline soft magnetic alloy powder produced by crystallizing an Fe-based amorphous soft magnetic alloy, wherein:

the Fe-based nanocrystalline soft magnetic alloy powder has a differential scanning calorimetry (DSC) curve with a first peak that is greater than 0% and 15% or less of a first peak of the Fe-based amorphous soft magnetic alloy in terms of a maximum value, a second peak occurring on a higher temperature side of the first peak of the Fe-based nanocrystalline soft magnetic alloy powder, and a third peak occurring on a lower temperature side of the second peak of the Fe-based nanocrystalline soft magnetic alloy powder and on a higher temperature side of the first peak of the Fe-based nanocrystalline soft magnetic alloy powder.

2. The Fe-based nanocrystalline soft magnetic alloy powder according to claim 1, wherein the second peak has a maximum value that is 50% or more and 100% or less of a maximum value of a second peak of the Fe-based amorphous soft magnetic alloy occurring on a higher temperature side of the first peak of the Fe-based amorphous soft magnetic alloy.

3. The Fe-based nanocrystalline soft magnetic alloy powder according to claim 1, wherein the third peak is smaller than the second peak in terms of a maximum value.

4. The Fe-based nanocrystalline soft magnetic alloy according to claim 1, wherein the second and third peaks occur in a temperature range that is −60° C. to +10° C. of a temperature at which the second peak of the Fe-based amorphous soft magnetic alloy occurs.

5. A dust core comprising the Fe-based nanocrystalline soft magnetic alloy powder of claim 1.

6. The Fe-based nanocrystalline soft magnetic alloy powder according to claim 1, wherein the Fe-based nanocrystalline is at least one of an Fe—Si—B-based alloy, an Fe—Cr—P-based alloy, an Fe—Zr—B-based alloy or an Fe—Si—B-based alloy with additional elements of Nb, Cu, P or C.

7. The Fe-based nanocrystalline soft magnetic alloy powder according to claim 1, wherein the first peak of the Fe-based nanocrystalline soft magnetic alloy powder is 10% or less of the first peak of the Fe-based amorphous soft magnetic alloy in terms of a maximum value.

8. The Fe-based nanocrystalline soft magnetic alloy powder according to claim 1, wherein the second peaks of the Fe-based nanocrystalline soft magnetic alloy powder have a maximum value that is 60% or more and 100% or less of a maximum value of a second peak of the Fe-based amorphous soft magnetic alloy occurring on a higher temperature side of the first peak of the Fe-based amorphous soft magnetic alloy.

9. The Fe-based nanocrystalline soft magnetic alloy powder according to claim 1, wherein the second and the third peaks occur due to different grain sizes.

* * * * *